US006210534B1

(12) United States Patent
Graf

(10) Patent No.: US 6,210,534 B1
(45) Date of Patent: Apr. 3, 2001

(54) TRIM SQUIRT FOR A PAPER-MAKING MACHINE

(75) Inventor: Edwin X. Graf, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/310,832

(22) Filed: May 12, 1999

(51) Int. Cl.[7] ..... D21F 1/34

(52) U.S. Cl. ..... 162/286; 162/353; 162/381; 83/177

(58) Field of Search ..... 162/286, 310, 162/275, 276, 380, 381, 353; 83/53, 177; 137/197; 96/220

(56) References Cited

U.S. PATENT DOCUMENTS 2,550,552 * 4/1951 Goodwillie ..... 162/340
2,717,539 * 9/1955 Metcalf ..... 162/275
3,007,519 * 11/1961 Hollis ..... 162/380
3,517,578 * 6/1970 Krofta ..... 162/286
3,839,148 * 10/1974 Beck ..... 162/310
4,146,052 * 3/1979 Bubik et al. ..... 162/380
4,262,700 * 4/1981 Moen ..... 162/380

FOREIGN PATENT DOCUMENTS

780850 * 11/1980 (SU) ..... 96/220

* cited by examiner

*Primary Examiner*—Karen M. Hastings
(74) *Attorney, Agent, or Firm*—Taylor & Aust, P.C.

(57) ABSTRACT

A paper-making machine for making a fiber web, includes a wire for carrying the fiber web. A trim squirt includes a nozzle cutter and an accumulator tank. The nozzle cutter is directed toward and transverse to the wire. The accumulator tank includes an inlet for receiving a pressurized fluid and an outlet fluidly connected with the nozzle cutter. The tank is structured and arranged to define an air attenuation pad therein.

16 Claims, 2 Drawing Sheets

TRIM SQUIRT FOR A PAPER-MAKING MACHINE

BACKGROUND OF THE INVENTION

1. Field of the Invention

The present invention relates to paper-making machines, and, more particularly, to trim squirts for use in paper-making machines.

2. Description of the Related Art

Paper-making machines typically include a head box which discharges a fiber suspension stream with a known cross-sectional profile onto a wire in a fourdrinier section. The wire carries the fiber web to a forming section, where the fiber web is transferred from the wire to the forming section. The lateral side edges of the fiber web which is carried by the wire typically are of poor quality. Accordingly, it is common to discharge the fiber suspension from the head box onto the wire with a width which is wider than the working width of the forming section. The fiber web is trimmed in the fourdrinier section using a pair of trim squirts which are placed along respective lateral side edges of the fiber web. Each trim squirt discharges a water stream at a relatively high velocity to cut the lateral side edges from the fiber web.

It is important that a trim squirt provide a continuous cut of the fiber web as the fiber web travels past the trim squirt toward the forming section. If the fiber web is not continuously cut, the fiber web will normally tear when it is transported to the narrower width forming section. An intermittent pause in cutting can be caused by a pressure fluctuation or an air bubble in the pressurized water which is supplied to the nozzle cutter of the trim squirt. Conventional trim squirts typically provide a pressurized fluid directly from a pump or the like to the nozzle cutter of the trim squirt. The flow velocity of the water is therefore affected by pressure fluctuations associated with rotational speed fluctuations of the pump. It is therefore possible that the fiber web may intermittently not be cut, thereby possibly resulting in tearing of the fiber web. Moreover, no provisions are made to remove air bubbles from the pressurized water which can likewise result in the web intermittently not being cut. Such air bubbles can occur from agitation or turbulence of the pressurized water.

What is needed in the art is a trim squirt which operates at a more constant pressure and without air bubbles to thereby ensure that the fiber web is continuously cut.

SUMMARY OF THE INVENTION

The present invention provides a trim squirt which cuts the fiber web in an uninterrupted manner and with minimum pressure fluctuations.

The invention comprises, in one form thereof, a paper-making machine for making a fiber web, including a wire for carrying the fiber web. A trim squirt includes a nozzle cutter and an accumulator tank. The nozzle cutter is directed toward and transverse to the wire. The accumulator tank includes an inlet for receiving a pressurized fluid and an outlet fluidly connected with the nozzle cutter. The tank is structured and arranged to define an air attenuation pad therein.

An advantage of the present invention is that the fiber web is cut in an uninterrupted manner.

Another advantage is that pressure fluctuations within the tank, and thus flow velocity fluctuations at the nozzle cutter, are minimized.

Yet another advantage is that the fluid level within the tank can be easily controlled without the use of sensors, electronic controls, etc.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
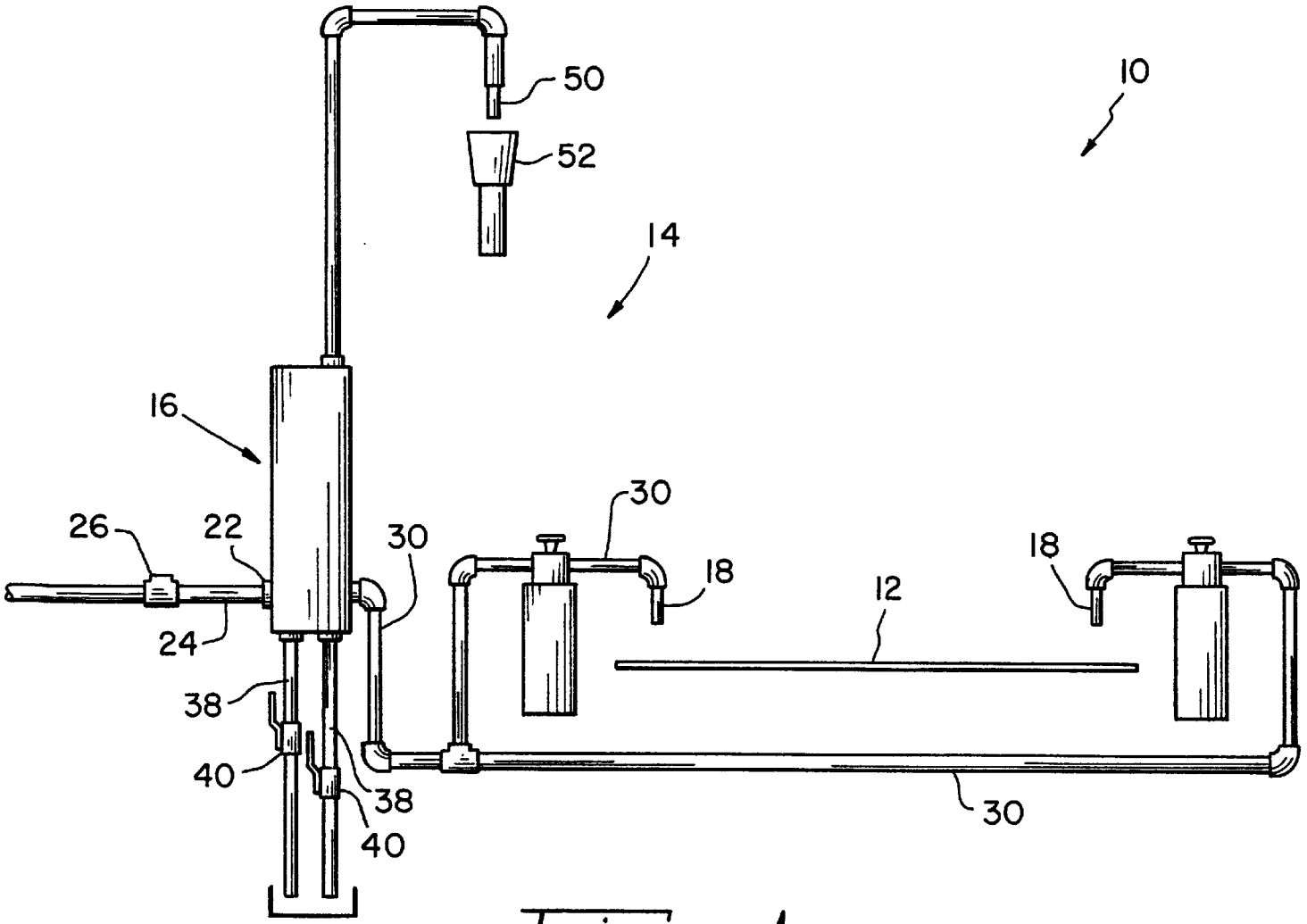
FIG. 1 is a schematic view of an embodiment of a paper-making machine of the present invention.

Referring now to the drawings, there is shown a portion of an embodiment of a paper-making machine 10 of the present invention for making a fiber web. Paper-making machine 10 generally includes a fourdrinier wire 12 and a trim squirt 14.

Wire 12 carries a fiber suspension web thereon and moves in a direction orthogonal to the drawing of FIG. 1. Typically, wire 12 receives a fiber suspension with a known cross-sectional profile from a head box (not shown). Water in the fiber suspension drains through wire 12 as it is carried from the head box toward a forming section (not shown). Although trim squirt 14 is shown with reference to a fourdrinier wire 12, it is also possible to position trim squirt 14 in a different part of paper-making machine 10. Accordingly, the term "wire" is used herein in a generic sense to mean a continuous traveling surface within paper-making machine 10 which carries a fiber web, such as a water impermeable belt, felt or wire. Wire 12 typically is carried by a plurality of rotatable rolls (not shown).

Trim squirt 14 generally includes an accumulator tank 16 and a pair of nozzle cutters 18. Each nozzle cutter 18 is positioned adjacent to a lateral side edge 20 of wire 12. Each nozzle cutter 18 includes an interior nozzle configuration which jets a stream of water at the fiber web carried by wire 12 at a predetermined velocity, dependent upon a target delivery pressure. The water jet is directed toward the fiber web carried by wire 12 at an angle generally perpendicular to wire 12.

Figure 2:
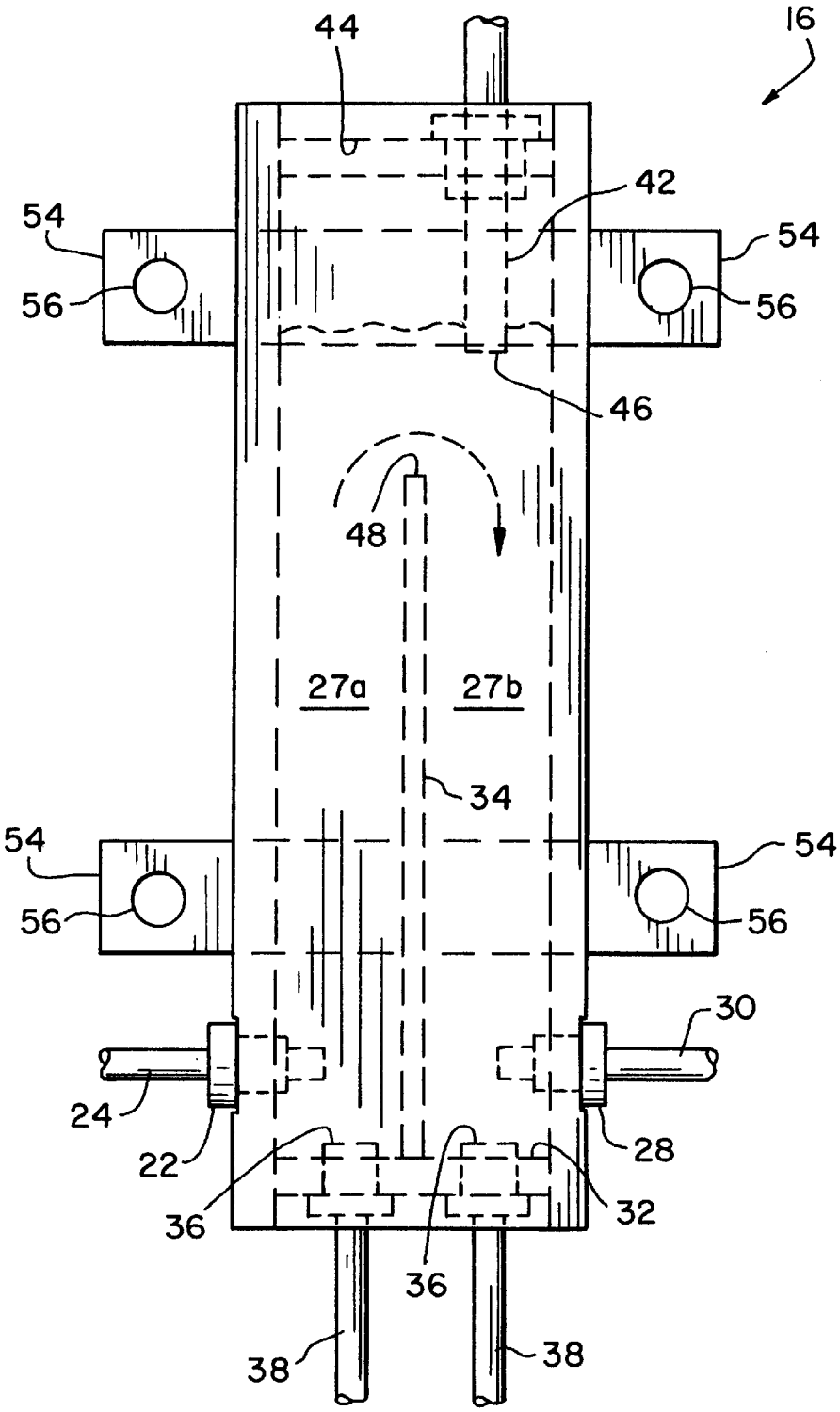
FIG. 2 is side view of the accumulator tank shown in FIG. 1.

Accumulator tank 16 (shown more specifically in FIG. 2) includes an inlet 22 for receiving a pressurized fluid from a fluid source such as a pump (not shown) via a fluid conduit 24. A check valve 26 may be provided in fluid conduit 24 which allows fluid flow only in a direction toward tank 16. Pressurized water flows through inlet 22 into a chamber 27A within tank 16.

Accumulator tank 16 also includes an outlet 28 which is fluidly connected with each of nozzle cutters 18 via fluid conduits 30. Each of inlet 22 and outlet 28 are positioned in a bottom half of accumulator tank 16. More particularly, in the embodiment shown, inlet 22 and outlet 28 are each positioned near a bottom 32 of accumulator tank 16. Outlet 28 receives pressurized fluid from a chamber 27B. Chamber 27B is separated from chamber 27A via an intermediate baffle 34. Pressurized fluid flows through chamber 27A, over the top of baffle 34, and then through chamber 27B.

Accumulator tank 16 also includes one or more drains 36 which are connected to respective drain lines 38. A pair of shut-off valves 40 are used to control fluid flow through drain lines 38, respectively. Each drain 36 is associated with a respective chamber 27A or 27B. Drains 36 may be connected with bottom 32 so that substantially all of the fluid within chambers 27A and 27B may be drained.

Accumulator tank 16 also includes a pipe 42 which extends downwardly from a top wall 44. Pipe 42 has a lower end 46 which sets an approximate liquid level of the pressurized fluid within accumulator tank 16, as will be described in more detail hereinafter. Lower end 46 of pipe 42 preferably is disposed above upper end 48 of baffle 34. It is also possible for lower end 46 of pipe 42 to be disposed substantially coterminous with or slightly below upper end 48 of baffle 34. Pipe 42 is exposed to ambient pressure at an end opposite from end 46. In the embodiment shown, pipe 42 includes an overflow end 50 which is exposed to ambient pressure and which may discharge fluid to a drain 52 for recycling, etc.

Accumulator tank 16 has a height dimension of at least 15 inches and a diameter of at least 4 inches to provide a volume which is sufficient to define an air attenuation pad above the pressurized fluid, as will be described in more detail hereinafter. In the embodiment shown, accumulator tank 16 has a height of at least 30 inches and a diameter of at least 6 inches. Optional mounting tabs 54 may be attached to accumulator tank 16 for mounting with appropriate structure within paper-making machine 10. For example, fasteners such as bolts may extend through holes 56 in tabs 54 and be threadingly engaged with corresponding threaded holes in a support structure of paper-making machine 10.

During use, pressurized fluid flows through check valve 26 and fluid conduit 24 into chamber 27A. The pressurized fluid flows in a generally upward direction through chamber 27A and flows over the top of baffle 34. When the liquid level within chambers 27A and 27B is below the lower end 46 of pipe 42, only ambient pressure exists within accumulator tank 16 and the liquid level rises. When the liquid level rises past lower end 46 of pipe 42, an air pocket is formed in the top of accumulator tank 16. The liquid level will continue to rise until the pressure of the pressurized liquid being pumped into accumulator tank 16 equals the pressure of the air attenuation pad above the liquid at the top of accumulator 16. Air bubbles within the pressurized fluid are allowed to bubble out of the fluid and into the air pad at the top of accumulator tank 16. If the air pad becomes too large, the air simply escapes through pipe 42 to the ambient environment. The air attenuation pad also helps to reduce fluctuations in the pressure of the fluid which is transported out from outlet 28. The pressurized fluid flows through chamber 27B and through outlet 28 to nozzle cutters 18 for cutting the lateral side edges from the fiber web carried by wire 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper-making machine for making a fiber web, comprising:

a wire for carrying the fiber web; and a trim squirt comprising:

a nozzle cutter directed toward and transverse to said wire, said nozzle cutter being structured and arranged to trim a respective lateral side edge of the fiber web on said wire; and an accumulator tank including an inlet for receiving a pressurized fluid and an outlet fluidly connected with said nozzle cutter, said tank being structured and arranged to define an air attenuation pad therein, a means for defining the air attenuation pad comprising a downwardly extending pipe mounted in said tank, said pipe having a lower end and an upper end, said lower end thereof setting an approximate liquid level in said tank, said upper end thereof being exposed to ambient pressure.

2. The paper-making machine of claim 1, further comprising a baffle within said tank, said baffle having an upper end which is disposed below said lower end of said pipe.

3. The paper-making machine of claim 1, further comprising a baffle within said tank.

4. The paper-making machine of claim 1, wherein said tank is a vertically extending cylinder with a height of at least 15 inches and a diameter of at least 4 inches.

5. The paper-making machine of claim 4, wherein said tank is a vertically extending cylinder with a height of at least 30 inches and a diameter of at least 6 inches.

6. The paper-making machine of claim 1, further comprising a check valve connected with said inlet and allowing flow toward said tank.

7. The paper-making machine of claim 1, wherein said inlet and said outlet are each positioned in a bottom half of said tank.

8. The paper-making machine of claim 7, wherein said inlet and said outlet are each positioned near a bottom of said tank.

9. The paper-making machine of claim 1, wherein said tank includes at least one selectively openable drain.

10. The paper-making machine of claim 9, wherein said drain is connected to a bottom of said tank.

11. The paper-making machine of claim 1, further comprising a second nozzle cutter, said outlet also being fluidly connected with said second nozzle cutter.

12. In a paper-making machine for making a fiber web, a trim squirt comprising:

a nozzle cutter being structured and arranged to trim a respective lateral side edge of the fiber web using a fluid stream; and an accumulator tank including an inlet for receiving a pressurized fluid and an outlet fluidly connected with said nozzle cutter, said tank including means for defining an air attenuation pad therein, said air attenuation pad defining means comprising a downwardly extending pipe mounted in said tank, said pipe having a lower end and an upper end, said lower end thereof setting an approximate liquid level in said tank, said upper end thereof being exposed to ambient pressure.

13. The trim squirt of claim 12, further comprising a baffle within said tank, said baffle having an upper end which is disposed below said lower end of said pipe.

14. The trim squirt of claim 13, wherein said tank is a vertically extending cylinder with a height of at least 30 inches and a diameter of at least 6 inches.

15. A trim squirt for use in a paper-making machine, comprising:

a nozzle cutter being structured and arranged to trim a respective lateral side edge of the fiber web using a fluid stream; and an accumulator tank including an inlet for receiving a pressurized fluid, an outlet fluidly connected with said nozzle cutter, a downwardly extending pipe mounted within said tank, said pipe having a lower end and an upper end, said lower end thereof setting an approximate liquid level in said tank and said upper end thereof being in fluid communication with ambient pressure, said downwardly extending pipe thereby being structured and arranged to define an air attenuation pad in said tank, and a baffle within said tank having an upper end which is disposed below said lower end of said pipe.

16. A paper-making machine for making a fiber web, comprising:

a wire for carrying the fiber web; and a trim squirt comprising:

a nozzle cutter directed toward and transverse to said wire, said nozzle cutter being structured and arranged to trim a respective lateral side edge of the fiber web on said wire; and an accumulator tank including an inlet for receiving a pressurized fluid and an outlet fluidly connected with said nozzle cutter, said tank being structured and arranged to define an air attenuation pad therein, a means for defining the air attenuation pad comprising a downwardly extending pipe mounted in said tank, said pipe having a lower end and an upper end, said lower end thereof setting an approximate liquid level in said tank, said upper end thereof being exposed to ambient pressure, said pipe thereby being both vented to ambient pressure and structured and arranged to set an approximate liquid level within said tank, said tank further including a baffle mounted therein, said baffle having an upper end which is disposed below said lower end of said pipe.

* * * * *